United States Patent [19]

Ballard et al.

[11] Patent Number: 5,050,885

[45] Date of Patent: Sep. 24, 1991

[54] GOLF SWING TRAINING APPARATUS

[75] Inventors: James T. Ballard, 9352 NW. 48, Miami, Fla. 33178; Norlin O. Lewis, Remlap; Carlton W. Montgomery, Clay, both of Ala.; Charles H. Birdsong, Meridian, Miss.

[73] Assignee: James Troy Ballard, Miami, Fla.

[21] Appl. No.: 620,271

[22] Filed: Nov. 30, 1990

[51] Int. Cl.[5] ..... A63B 69/36

[52] U.S. Cl. ..... 273/183 B; 273/188 R; 434/252

[58] Field of Search ..... 434/252; 273/183 B, 273/188 R, 188 A, 189 R, 189 A, 190 R, 190 A, 190 B

[56] References Cited

U.S. PATENT DOCUMENTS

| | | | |
|---|---|---|---|
| 1,530,519 | 3/1925 | Remington | 273/188 R |
| 1,854,392 | 4/1932 | Bambrick | 434/252 X |
| 2,611,610 | 9/1952 | Hara | 273/188 R |
| 2,626,151 | 1/1953 | Jenks | 273/186 A |
| 2,737,432 | 3/1956 | Jenks | 434/252 |
| 2,755,091 | 7/1956 | Hara | 273/188 R |
| 3,138,388 | 6/1964 | Herold | 273/188 R |
| 3,215,438 | 11/1965 | Sheldon et al. | 273/188 R |
| 3,415,523 | 2/1968 | Boldt | 434/252 X |
| 3,429,571 | 2/1969 | Abel, Jr. | 273/191 R X |
| 3,876,212 | 4/1975 | Oppenheimer | 273/186 R |
| 3,895,366 | 7/1975 | Morris | 273/186 R X |
| 3,917,281 | 11/1975 | Oppenheimer | 273/191 B |
| 4,034,991 | 7/1977 | Oppenheimer | 273/186 A |
| 4,071,251 | 1/1978 | Beckish | 273/186 R |
| 4,211,418 | 7/1980 | Oppenheimer | 273/186 R |
| 4,326,718 | 4/1982 | Kiehl | 273/190 R X |
| 4,593,909 | 6/1986 | Anselmo et al. | 273/188 R |
| 4,659,084 | 4/1987 | Vuick | 273/183 B X |
| 4,691,924 | 9/1987 | Strong | 273/189 R |

OTHER PUBLICATIONS

"How To Perfect Your Golf Swing Using 'Connection' and the Seven Common Denominators", Jimmy Ballard, 1981.

*Primary Examiner*—George J. Marlo
*Attorney, Agent, or Firm*—Brumbaugh, Graves, Donohue & Raymond

[57] ABSTRACT

A golf swing training apparatus having a saddle for attachment to the hips of a golfer, a first assembly to guide the saddle laterally during the golf swing, a second assembly to promote opposite hip rotations during the golfer's backswing and follow-through, respectively, and a third assembly to position the golfer's shoulders throughout the swing. The first assembly includes a traveler mounted to move laterally on a straight track which is rotatably mounted on a pivotable connecting assembly which is supported by a base. The second assembly is a spring and hinge assembly having a first hinge around which the saddle rotates during the backswing and a second hinge around which the saddle rotates during the follow-through. The third assembly includes a vest worn by the golfer, a rigid back plate, a vertically extensible support assembly rotatably mounted on the saddle and tension means which apply rotational force to the support assembly during the backswing. A leg movement limiting device is attached to the base or positioned on the surface on which the golfer stands to limit the golfer's leg movement during the golf swing.

16 Claims, 15 Drawing Sheets

GOLF SWING TRAINING APPARATUS

BACKGROUND OF THE INVENTION

The invention relates to a golf swing training apparatus and more particularly to a device specifically adapted to promote and encourage proper movement of a golfer during the course of a series of practice swings (with or without a ball) to aid the golfer in developing a desired golf swing.

Over the years, a number of patents have been issued directed to apparatus to train golfers in the "perfect" swing. These devices have functioned in various ways to guide or control a portion or all of the golfer's body during a series of practice swings. Since the nature of the desired swing has varied from device to device, the prior art devices have acted in a number of different ways to produce substantially different swings in a golfer. These prior art devices have emphasized upper body, head, shoulder and arm movement while either ignoring or severely limiting the golfer's hip movement.

For example, C. D. Remington U.S. Pat. No. 1,530,519, which issued on Mar. 24, 1925, shows a typical golf training apparatus which is designed to prevent any vertical or upward motion during a golf swing. The golfer is forced to pivot his body, including his hips, around a rigid axis. Similarly, U.S. Pat. No. 2,611,610, issued to J. R. O'Hara on Sept. 23, 1952, shows an apparatus which holds the shoulders, hips and feet in position during the golf swing. The mechanism does not encourage lateral motion in the hips and corresponding movement of the shoulders, but rather, through hip engaging pads, limits lateral movement of the hips.

G. M . T. Jenks U.S. Pat. Nos. 2,626,151 and 2,737,432, which issued on Jan. 20, 1953 and Mar. 6, 1956, respectively, show a golf training apparatus which coordinates the body movements during a swing. While these patents recognize that hip motion during a swing should have some lateral component, the mechanisms of the patents severely restrict any such motion. Like other prior art, the hip motion of the golfer in this device is still essentially restricted to rotation about the central axis of the device.

J. R. O'Hara U.S. Pat. No. 2,755,091, which issued on July 17, 1956, shows a device to teach body movement during a golf stroke where the golfer's hips are confined to a rotary motion about a single axis. Similarly, R. Abel, Jr. U.S. Pat. No. 3,429,571, which issued on Feb. 25, 1969, discloses a motor driven swing training device in which a hip harness rotates about a single axis without allowing or promoting lateral action. S. E. Sheldon et al. U.S. Pat. No. 3,215,438, which issued on Nov. 2, 1965, discloses a hip training device for golfers where a warning signal is given when there is a departure from rotation of the hips about a single axis. Anselmo et al. U.S. Pat. No. 4,593,909, which issued on June 10, 1986, also discloses a golf training aid having a number of belts which force a golfer into a particular swing. The teachings of this patent do not promote lateral motion of the hips.

SUMMARY OF THE INVENTION

Through his thirty years of teaching and his study of golfers, both on the course and by video tapes and photographs, James Ballard has found that the traditional concept of rotating the hips around a central axis during a golf swing is incorrect. Greater power and control is obtained for a swing which emphasizes lateral hip movement.

During the backswing, a right-handed golfer's hips should move laterally to the right, while the golfer's weight shifts to his right foot, i.e. coiling into the set of his right leg. The hips may rotate up to 45 degrees from the original address position.

During the downswing, both hips should move laterally toward the target where the ball is to land (i.e., a left lateral motion) as the right hip simultaneously swings out. The hips move through the original address position and then, during the follow-through, to one position where both hips face the target or possibly face to the left of the target. At the start of the downswing, the shoulders swing the arms, and in doing so, lag behind the hips until they come even at about impact with the ball. At the striking point, the hips, the shoulders, and the golf club shaft reach a position closely approximating the original address position. The feet, legs and hips coordinate as in a chain reaction to provide the basis for the motion from the ground up. This motion, which will be more fully discussed later, is called the "Ballard Swing" and is set forth in his book *How To Perfect Your Golf Swing* (Golf Digest/Tennis Inc. 1981) and in his 1989 video, *The Fundamental Swing* produced by Reid Dolph, Inc. The prior art training devices do not train the golfer in the Ballard swing. In fact, most work actively to prevent such motion.

The golf training apparatus of the present invention urges the golfer to make the Ballard Swing, i.e., its combination of lateral and rotational hip motion with the golfer's weight coiling into the set of the right leg with the corresponding correct upper body, shoulder and arm motion. The Ballard swing is induced by use of a hip saddle worn by the golfer which limits and guides his hip movement. The hip saddle travels along a horizontal track which allows lateral right-left movement. The hip saddle is attached to the track by a double hinge mounting means. This allows rotational movement of the hip saddle. The golfer wears a vest having a rigid bar attached across the shoulders. This shoulder bar is connected to a floating shaft assembly. The floating shaft assembly is, in turn, pivotally mounted on the hip saddle mounting means. Thus the position of the base of the floating shaft assembly changes as the hip saddle moves through the swing. Various springs and elastic members urge proper coordination of the movement of the hip saddle and the rigid shoulder bar. There is also an adjustable leg stop placed at a position corresponding to the ideal reversal point of the swing, i.e. when the golfer shifts from the backswing to downswing. This stop acts both as a target for the right leg and to limit the lateral motion and degree of weight shift.

In use, the golfer makes a series of practice swings where, if desired, he can actually strike the ball while being guided by the apparatus of the present inventors and thereby develop the desired swing.

BRIEF DESCRIPTION OF THE DRAWINGS

The invention will be better understood from the detailed description below, taken in conjunction with the drawing wherein like reference characters refer to like parts throughout and in which.

DETAILED DESCRIPTION OF THE INVENTION

Figure 1:
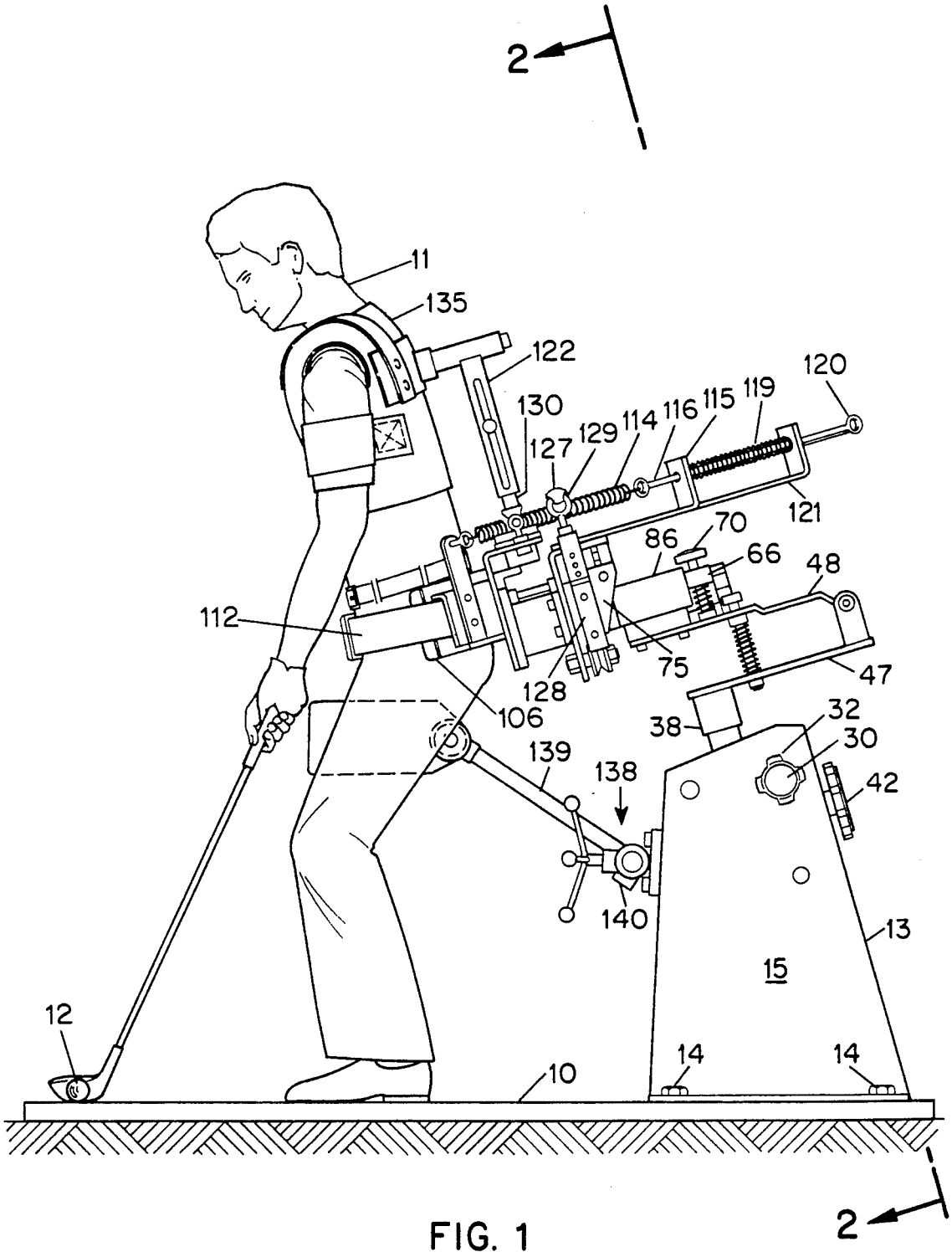
FIG. 1 is a side elevational view of the apparatus of the present invention set up for a right-handed golfer, in use.
Figure 2:
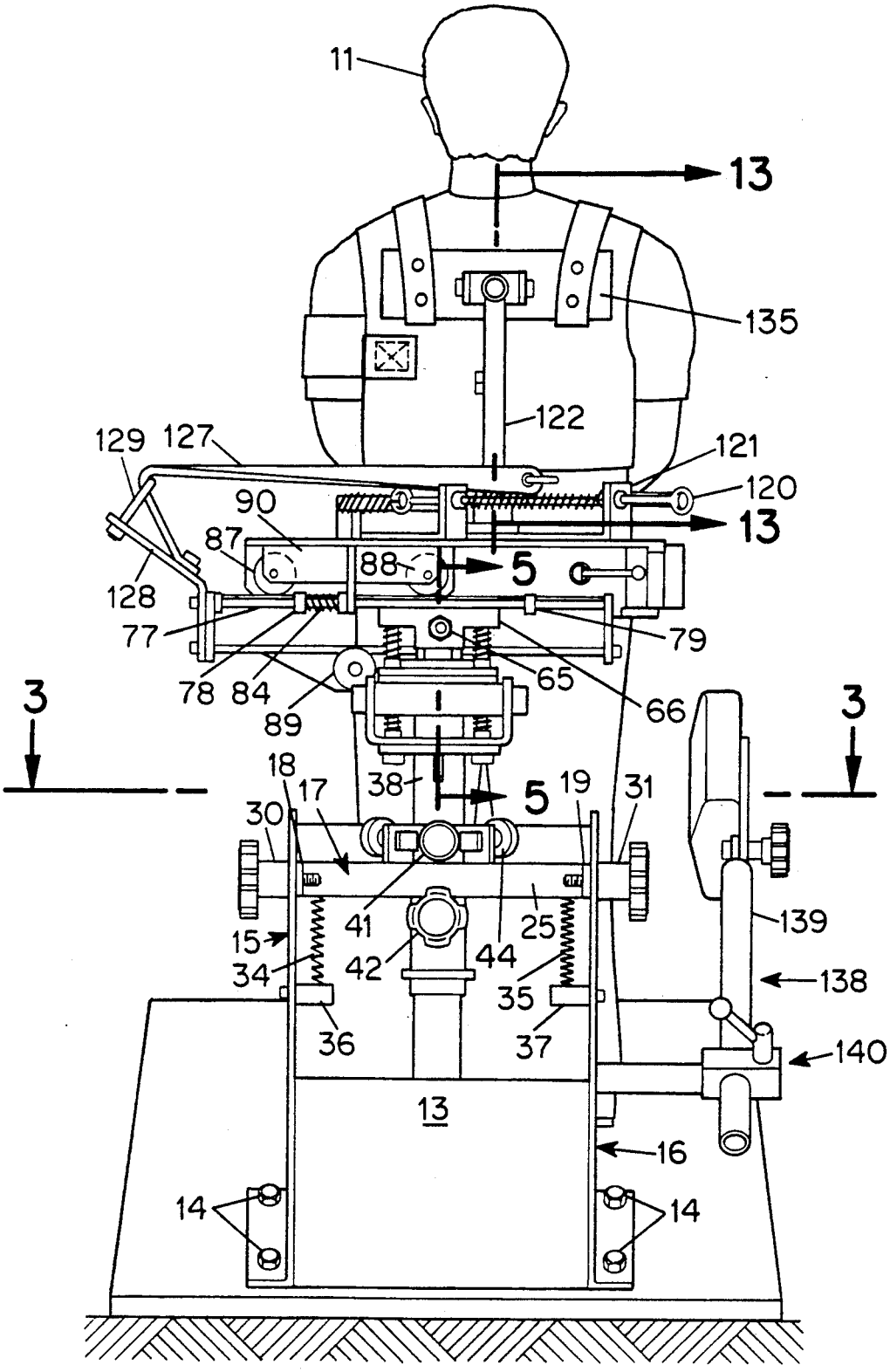
FIG. 2 is a rear elevational view of the apparatus of FIG. 1 taken along the plane 2—2 of FIG. 1.
Figure 4:
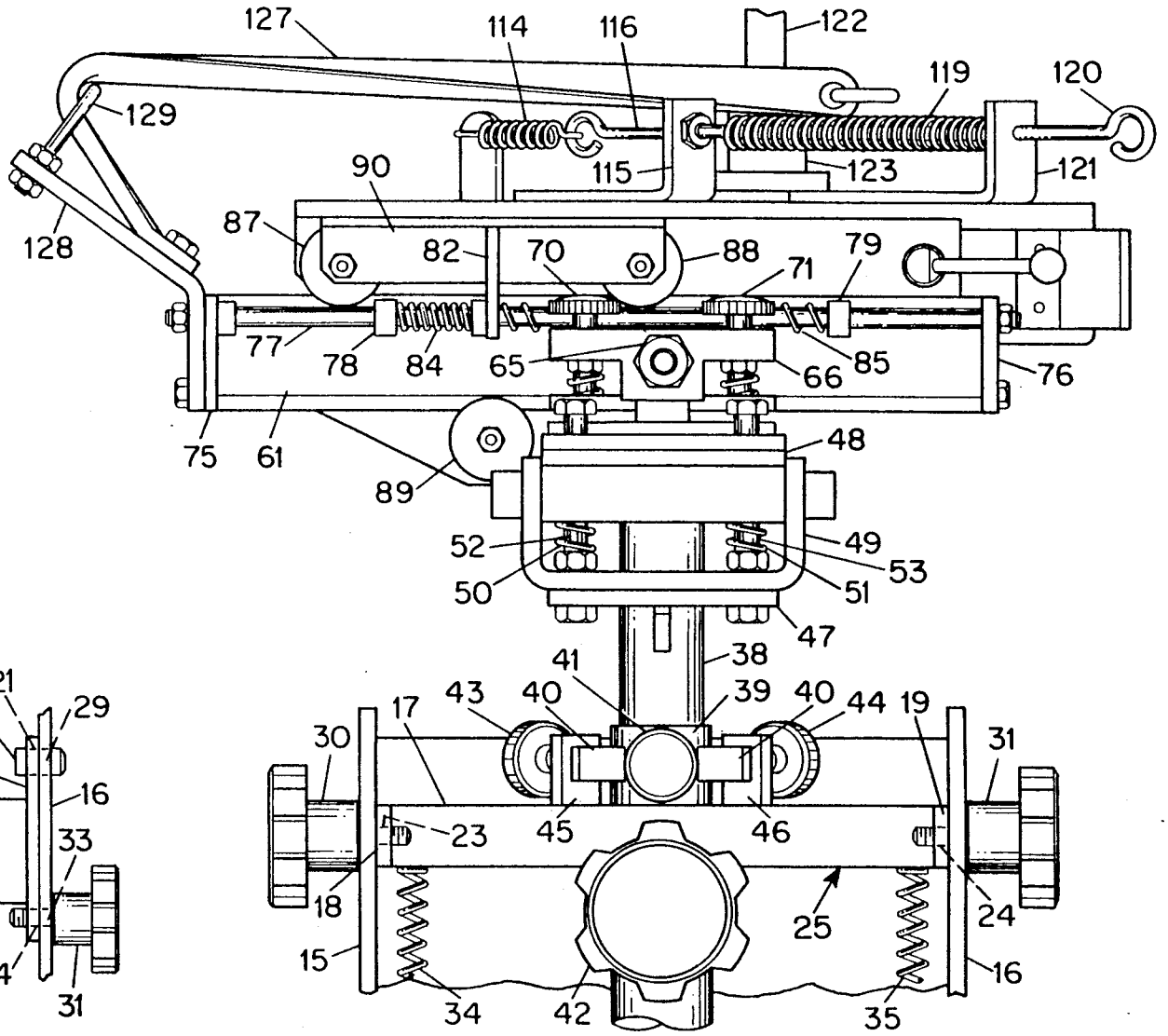
FIG. 4 is a fragmentary rear view of the support assembly of the present invention.
Figure 3:
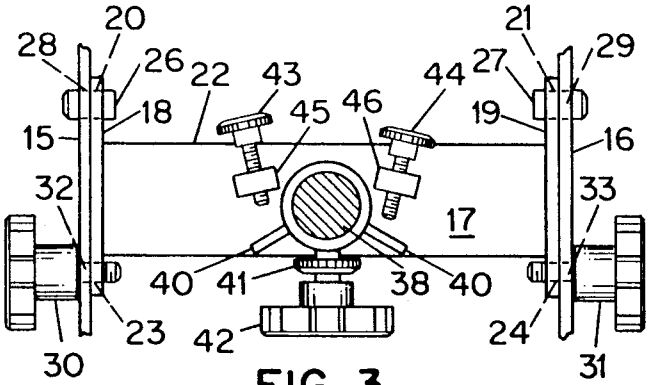
FIG. 3 is a fragmentary top view of a segment of the apparatus showing the swing collar as seen from plane 3—3 of FIG. 2.
Figures 5, 6:
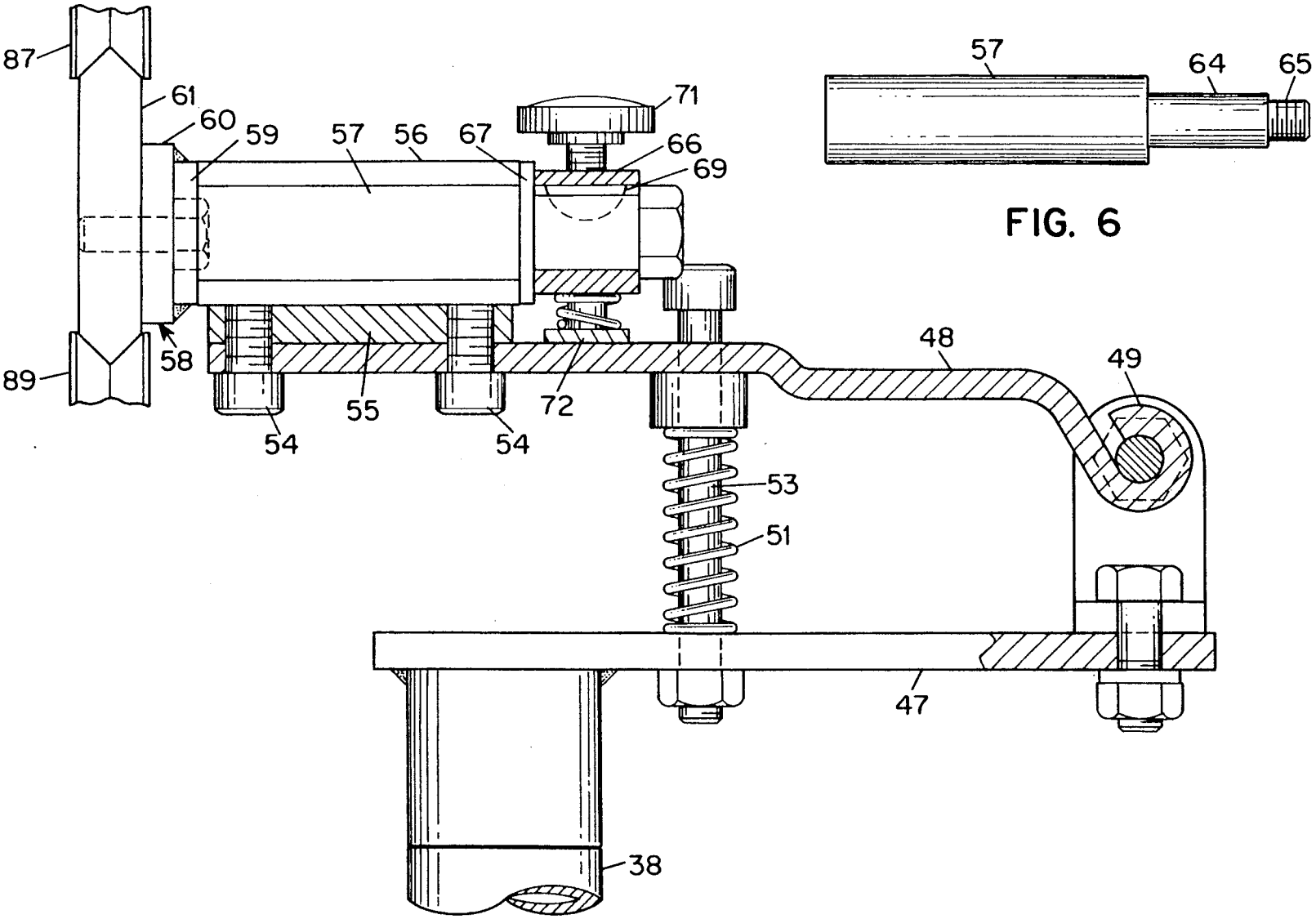
FIG. 5 is a fragmentary side view of the present invention as seen from plane 5—5 of FIG. 2.
FIG. 6 is a side view of a shaft.

FIGS. 1-17 show a golf training apparatus for a right-handed golfer in accordance with the present invention. A plate 10 acts both as a platform upon which the rest of the apparatus is mounted and a base upon which a golfer 11 and a golf ball 12 may be positioned during training. Attached to plate 10 is the base 13 which is fixedly mounted on the plate 10 by an attaching means such as nuts and bolts 14. Alternatively, the base 13 may be directly mounted on a floor or on a concrete slab positioned in the ground (not shown).

The base 13 consists of two end plates 15 and 16 connected at the top by base saddle 17. The base saddle 17 has attached at its ends mounting plates 18 and 19. The mounting plates 18 and 19 have holes 20 and 21 (shown by dotted lines) near the leading edge 22 of the base saddle 17 and holes 23 and 24 (shown by dotted lines) near the following edge 25 of the base saddle 17. The base saddle 17 is held in position by pivot pins 26 and 27 rotatably mounted in holes 20 and 21 and corresponding holes 28 and 29 in end plates 15 and 16 respectively. Attaching means 30 and 31, mounted through holes 23 and 24 in the mounting plates 18 and 19 and in crescent shaped openings 32 and 33 in end plates 15 and 16, hold the following edge 25 of the base saddle 17 in slidable engagement with end plates 15 and 16. While the attaching means 30 and 31 can be tightened to lock the base saddle 17 in position when not in use, in operation the attaching means 30 and 31 are loosened to allow free movement of the following edge 25 of the base saddle 17 in the crescent shaped openings 32 and 33. Alternatively, the attaching means may be a simple pin mounted through holes 23 and 24 and crescent shaped openings 32 and 33 respectively and held in place by any convenient means without a means to clamp the base saddle 17 in position.

The forward movement of the base saddle 17 is controlled by springs 34 and 35 which are attached to the following edge 25 of base saddle 17 by any convenient means and to end plates 15 and 16, by conventional mounting means 36 and 37. Springs 34 and 35 allow vertical movement of the hips and shoulders of a golfer during a practice swing. In normal use, springs 34 and 35 are in tension during a golf swing.

A tubular mounting stand 38 is positioned in a hole (not shown) in base saddle 17. Positioned on stand 38 is swing collar 39 having integrally positioned fins 40. Swing collar 39 is held in fixed relation to mounting stand 38 by set screw 41 while allowing rotation of the mounting stand 38 relative to base saddle 17. Swing collar 39 acts to set the maximum height mounting stand 38 may move vertically relative to base saddle 17 during the initial adjustment of the mounting stand. However, after the initial adjustment for a golfer's height, set screw 42 fixes the vertical position of the mounting stand 38 relative to base saddle 17 and does not allow vertical, i.e., height, movement of the mounting stand 38 relative to the base saddle 17 during a swing. Alternate means, such as a lever action assembly (not shown), may be used to adjust the relative position of the base saddle 17 and the mounting stand 38.

Set screws 43 and 44 mounted on base saddle 17 by means of threaded support elements 45 and 46 co-act with fins 40 to limit rotation of the swing collar 39 and thus mounting stand 38, relative to the base saddle 17. In normal operation, set screw 44 is adjusted to extend further through support 46 than set screw 43 through support 45. This allows greater rotation of the stand 38 in the backswing than in the downswing. Alternatively, set screws 43 and 44 may be replaced by fixed stops properly positioned to appropriately limit rotation of the swing collar 39.

Mounted on the top of stand 38 is a base plate 47. As seen most clearly in FIGS. 4 and 5, base plate 47 is operatively connected to traveler support plate 48 by hinge assembly 49. Springs 50 and 51 are held in place by bolt assemblies 52 and 53 positioned between base plate 47 and traveler support plate 48. The springs 50 and 51 act to support the weight of the upper portion of the apparatus and let it float freely up and down while simultaneously absorbing shocks transmitted during the swing.

Mounted on traveler support plate 48 by bolts 54 and plate 55 is a shaft casing 56 having a stepped shaft 57 freely rotatable therein. One end of shaft 57 is fixedly attached to stepped plate 58 having a cylindrical portion 59 mounted on a larger rectangular portion 60. Since shaft 57 is free to rotate relative to shaft casing 56, plate 58 is also free to so rotate. Plate 58 is in turn attached to traveler bar 61 by bolts 62 and 63 on either side of the shaft casing 56. The other end of shaft 57 is reduced in size first at 64 and then further reduced in size and threaded at 65. Mounted on the first reduced portion 64 is tee shaped shaft rotational limiting means 66. Positioned between the shaft casing 56 and the shaft rotational limiting means 66 on shaft 57 is washer 67. The threaded end 65 of the shaft 57 engages nut 68 which holds the shaft 57 in place. Shaft 57 is held in position relative to the shaft rotational limiting means 66 by woodruff key 69. By this arrangement, traveler bar 61 is allowed limited rotation in a vertical plane.

Shaft rotational limiting means 66 has two screw adjustments 70 and 71. The screw adjustments 70 and 71 extend only partway between the arms of the shaft rotational limiting means 66 and a plate 72 fixedly mounted on traveler support 48. Springs 73 and 74 are mounted on screw adjustments 70 and 71 between the arms of the shaft rotation limiting means 66 and the plate 72. The combination of these elements acts to allow limited rotational movement of the shaft 57 while absorbing the energy imparted by any such movement. This in turn limits the amount of rotation traveler bar 61 may make.

Figure 7:
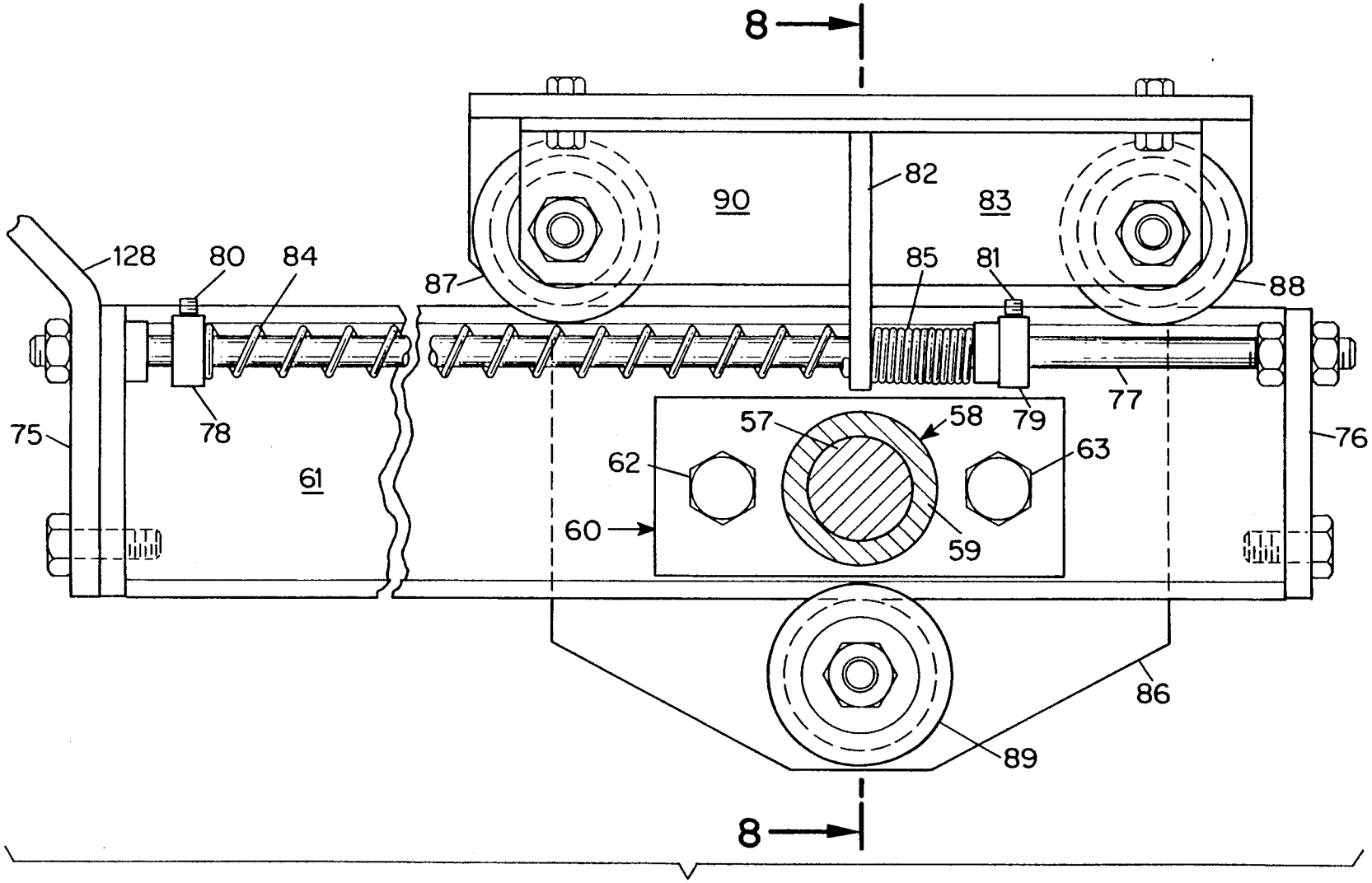
FIG. 7 is a fragmentary back view of the traveler assembly of the present invention.

As can be seen most clearly in FIG. 7 attached to the ends of the traveler bar 61 are end plates 75 and 76. Mounted on and between end plates 75 and 76 is traveler rod 77. Mounted on rod 77 is downswing stop 78 and backswing stop 79. Downswing stop 78 is held in position on rod 77 by set screw 80 and backswing stop 79 is held in position by set screw 81. As will be more fully explained hereafter, stops 78 and 79 interact with traveler stop 82 mounted on traveler assembly 83. Traveler stop 82 consists of a plate having a hole through which rod 77 passes. Spring 84 is mounted on rod 77 between downswing stop 78 and the traveler stop 82. Spring 85 is mounted between traveler stop 82 and backswing stop 79.

The traveler assembly 83 includes a traveler mounting plate 86 on which are mounted three wheels 87, 88, and 89. The wheels 87, 88, and 89 are positioned on either side and in engagement with the traveler bar 61. Wheel 87 is positioned on the upper surface of traveler bar 61 between end plate 75 and traveler stop 82. Wheel 88 is similarly positioned between traveler stop 82 and end plate 76. Wheel 89 is positioned on the opposite side of the traveler bar 61. The traveler assembly 83 moves laterally along traveler bar 61. The traveler stop 82 is mounted on the traveler mounting plate 86 by means of a support plate 90. Thus traveler stop 82 co-acts with springs 84 and 85, backswing stop 79 and downswing stop 78 to both limit motion of the traveler assembly 83 and to absorb shock incurred in controlling the motion of the golfer during a practice swing.

The traveler assembly 83 is attached to a hip saddle 91, which is worn on the golfer's hips, through a hinge assembly 92 having two hinges 93 and 94 as seen in FIGS. 15–18. Support arms 95 and 96 are mounted on traveler assembly 83 and are joined together and to arm 97 attached to hinge 94. Arm 98 is also attached to hinge 94 around which it rotates. Attached to arm 98 is arm extension 99. Elastomeric bumpers 100 and 101 are mounted on arms 97 and 98 respectively to cushion against shock when arm 98 comes into contact with support arm 96 or arm 99 comes into contact with arm 97. Arm extension 99 is attached at its other end to one side of hinge 93. The other arm 102 of hinge 93 is attached to the hip saddle 91. Elastomeric bumper 103 and an adjustable limit stop 104 are attached to hinge 93 where hinge 93 is attached to arm extension 99.

The hip saddle 91 has two padded surfaces 105 and 106 which are attached to support plates 107 and 108, respectively. Support plates 107 and 108 are slidably attached to a back plate 109. Support plates 107 and 108 may be secured against movement relative to plate 109 by conventional adjusting means 110. Attached to support plates 107 and 108 are belt straps 111 and 112 which are held together in a conventional manner. Attached to support plate 108 is an eyelet 113 to which one end of spring 114 is attached. The other end of spring 114 is attached by an adjustable eyelet 116 to an arm 115 mounted on traveler assembly 83.

The backplate 109 is attached to back support saddle platform 117. Eyelet 118 is mounted on back support saddle platform 117. Attached to eyelet 118 is one end of spring 119 whose other end is attached by an adjustable eyelet 120 to arm 121 mounted on traveler 83. Also mounted on back support saddle platform 117 is back support assembly 122. Back support assembly 122 is mounted on pivot assembly 123 in such a manner as to allow comparatively free movement of the back support assembly 122. A ball bearing race 124 mounted in pivot assembly 123 allows rotational movement of the back support assembly 122. The bottom of back support assembly 122 is mounted in a rubber support 125 in such a manner as to allow free movement from the vertical, so that the combined action of these elements is similar to that of a ball joint. Mounted on back support assembly 122 is adjustable eyelet 126 to which is attached one end of elastomeric strap 127. The other end of the elastomeric strap 127 is attached through an adjustable eyelet 129 to arm 128 mounted on the end plate 75 of the traveler bar 61. Tension in strap 127 can be adjusted by shifting the position of eyelet 129 along arm 128.

A square hollow tube 130 forms the portion of the back support assembly 122 immediately above eyelet 126. Mounted on support assembly 122 is a mating upper free-floating back support assembly 131 vertically extensible in slidable engagement with tube 130. Free-floating upper back support assembly 131 has slots 132 on opposite sides corresponding to a series of holes 133 on opposite sides of square tube 130 of the back support assembly 122. A nut and bolt assembly 134 can thus be positioned through free-floating upper back support assembly 131 and hollow tube 130 limiting the relative motion between them.

The upper end of the free floating upper back assembly 131 is attached to rigid plate 135. The rigid plate 135 in turn is attached across the shoulders of a vest 136 to be worn by the golfer 11. The vest attaches across the front by conventional means and has an arm connector 137 in accordance with the teachings of U.S. Pat. No. 4,691,924.

Attached to base 13 is a target and leg movement limiting device 138 consisting of an arm 139 attached to base 13 by an adjusting means 140 which allows arm 139 to be pivoted around the point at which it is attached to the base 13 and at the same time allows adjustment of the lateral distance of said arm 139 from the golfer's leg. The other end of arm 139 is attached to a pad 141 whose position may also be adjusted. Thus the position of pad 141 may be adjusted laterally in the same direction as the movement of the traveler assembly 83 and vertically so that the pad 141 may be located at the proper position to correctly limit leg movement in the reversal point between the backswing and the downswing. The leg movement limiting device may be alternatively attached to the surface on which the golfer stands.

Figure 18:
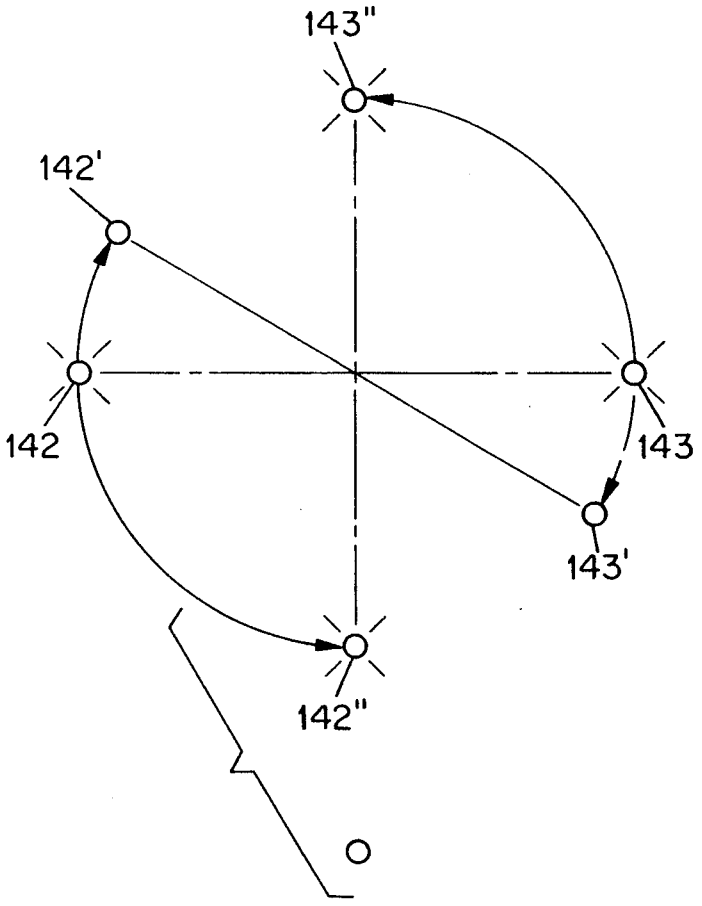
FIG. 18 PRIOR ART
FIG. 18 is a schematic diagram of the hip motion induced by prior art devices.
Figure 8:
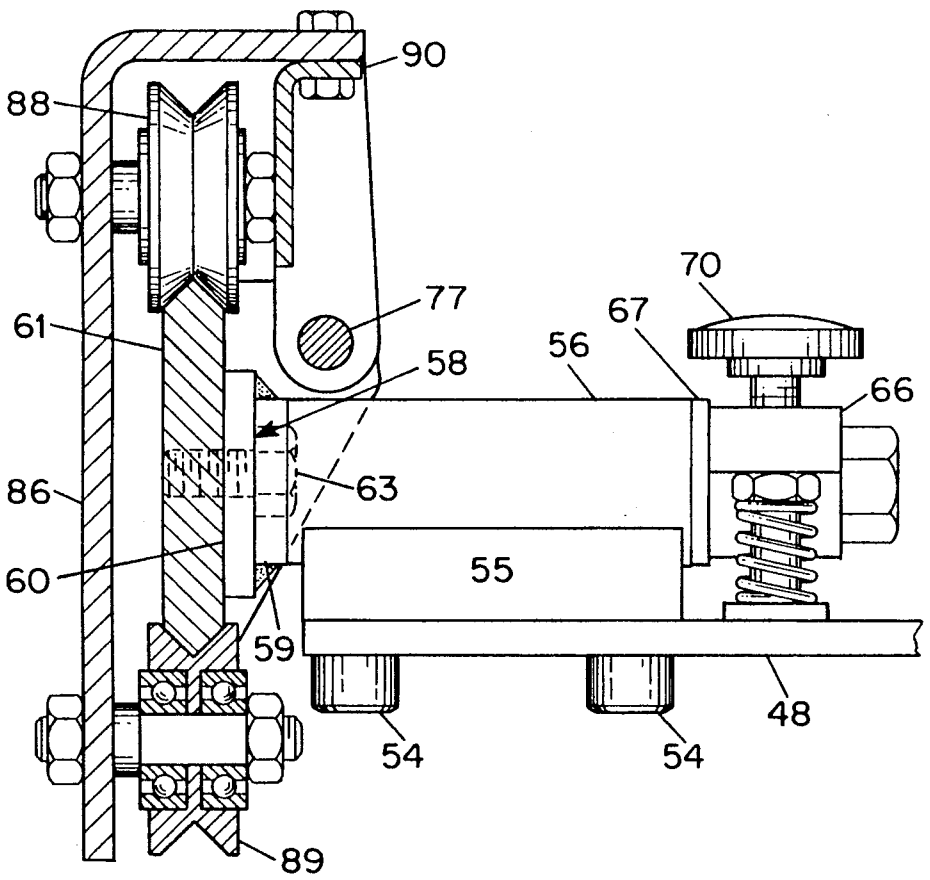
FIG. 8 is a cross-sectional side view of the traveler assembly of the present invention as seen from plane 8—8 of FIG. 7.
Figure 9:
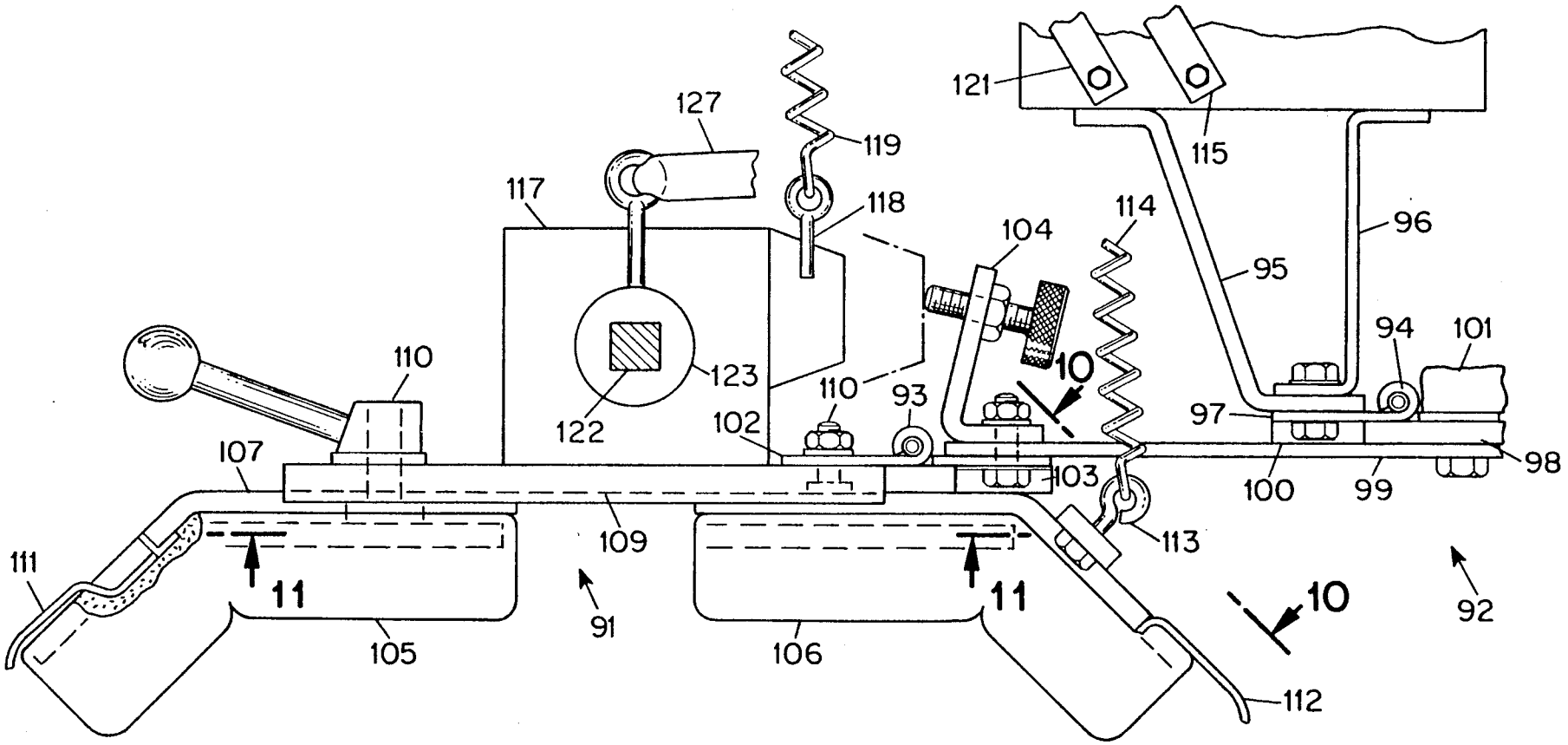
FIG. 9 is a top view of the hip saddle assembly of the present invention.
Figure 11:
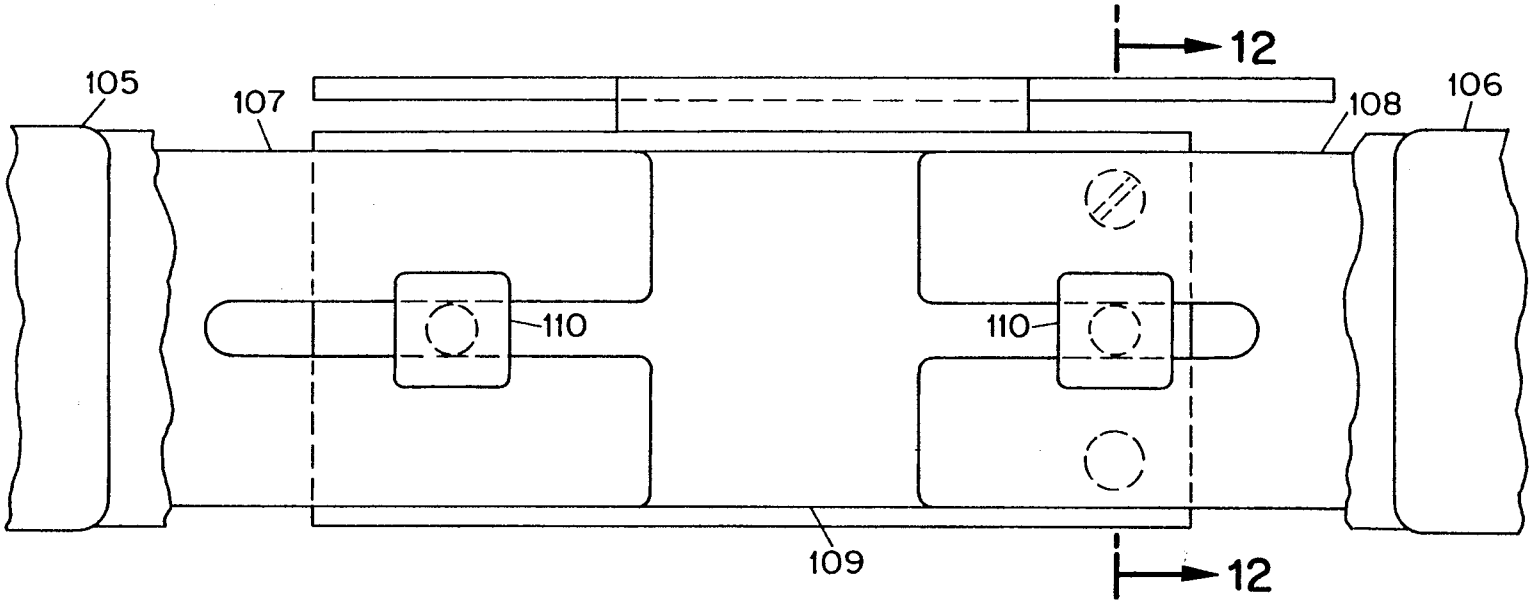
FIG. 11 is a fragmentary partial front view of the hip saddle assembly of the present invention as seen from plane 11—11 of FIG. 9.
Figure 12:
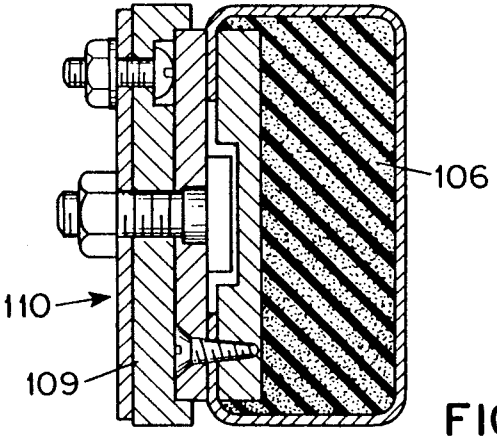
FIG. 12 is a cross-sectional view of the hip saddle of the present invention as seen from plane 12—12 of FIG. 11.
Figure 10:
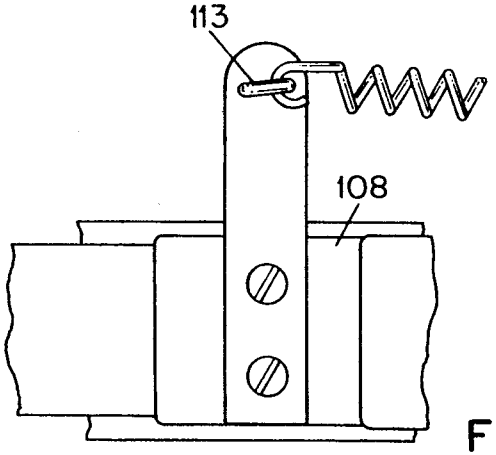
FIG. 10 is a partial end view of the hip saddle.
Figure 13:
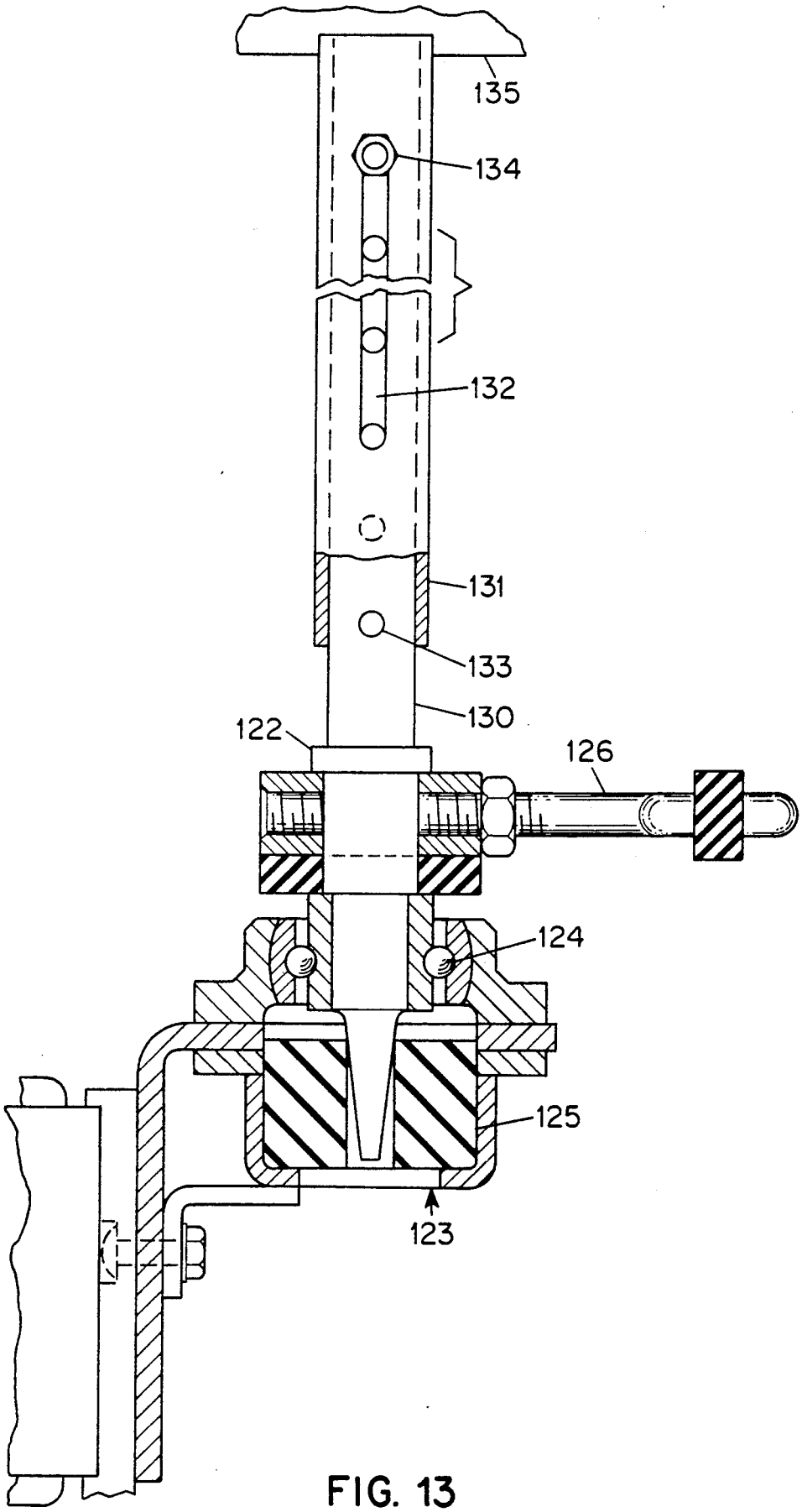
FIG. 13 is a cutaway fragmentary side view of the floating shaft subassembly of the present invention.
Figure 14:
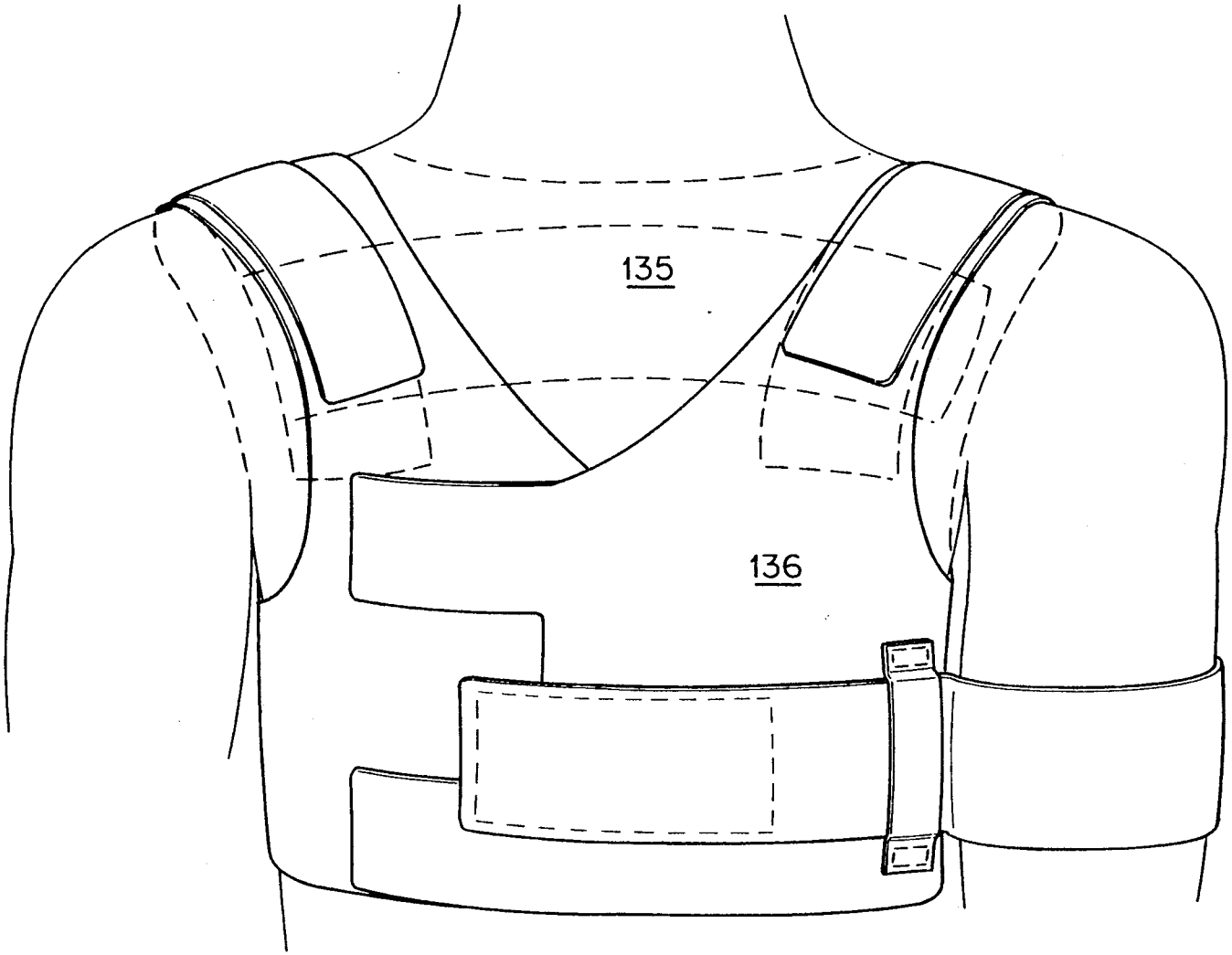
FIG. 14 is a pictorial representation of the vest used in the present invention showing alternatives to the back of the vest by dotted lines.

As discussed above, prior art golf training devices, if they were concerned with hip movement at all, limited such movement to rotation around a single axis as shown in FIG. 18. As shown in the prior art in the initial address position, the right hip 142 and left hip 143 were aligned at right angles to the ball 12. During the backswing the hips rotated clockwise such that the right hip was positioned at 142' and the left hip at 143'. During the downswing, the hips rotated counter clockwise so that at the end of the swing the right and left hips were positioned at 142'' and 143'' respectively and approximately aligned at right angles to their original address position.

In contrast, the present invention teaches the Ballard swing. During the backswing in a Ballard swing, a right-handed golfer's hips should move laterally to the right while his right foot is set in position perpendicular to the intended line of flight of the ball. The golfer's weight shifts to his right foot, coiling into the set of the right leg. The golfer feels pressure on the inside ball of the right foot, right knee and inside the upper thigh or groin area. The golfer's left hip rotates up to but no more than 45 degrees from the original address position. During the downswing, both hips should move laterally toward the target where the ball is to land (i.e., a left lateral movement) as the right hip simultaneously swings out (i.e., a rotational hip movement). The hips move through the original address position and then, during the follow-through, to the position where both hips face the target or possibly face to the left of the target. At the start of the downswing, the shoulders swing the arms, and in doing so, lag behind the hips until they come even at about impact with the ball. At the striking point, the hips, the shoulders, and the golf club shaft reach a position closely approximating the original address position. The feet, legs and hips provide the basis for the motion from the ground up.

The operation of the present invention, to produce the swing, can be seen most clearly in FIGS. 19 through 26. In the Ballard swing, at the address position, the legs are braced, knees knocked in slightly, the feet are spread to shoulder width (i.e. the distance between the golfer's feet is the same as the outside measurement of the golfer's shoulders) and the ball is played off the inside of the left heel for normal trajectory shots. Weight is on the inside of the feet with the large inside muscles engaged. The knees and hips are level, the right shoulder is directly under the left only because the right hand is placed below the left hand and lower down the shaft on the club.

Figure 15:
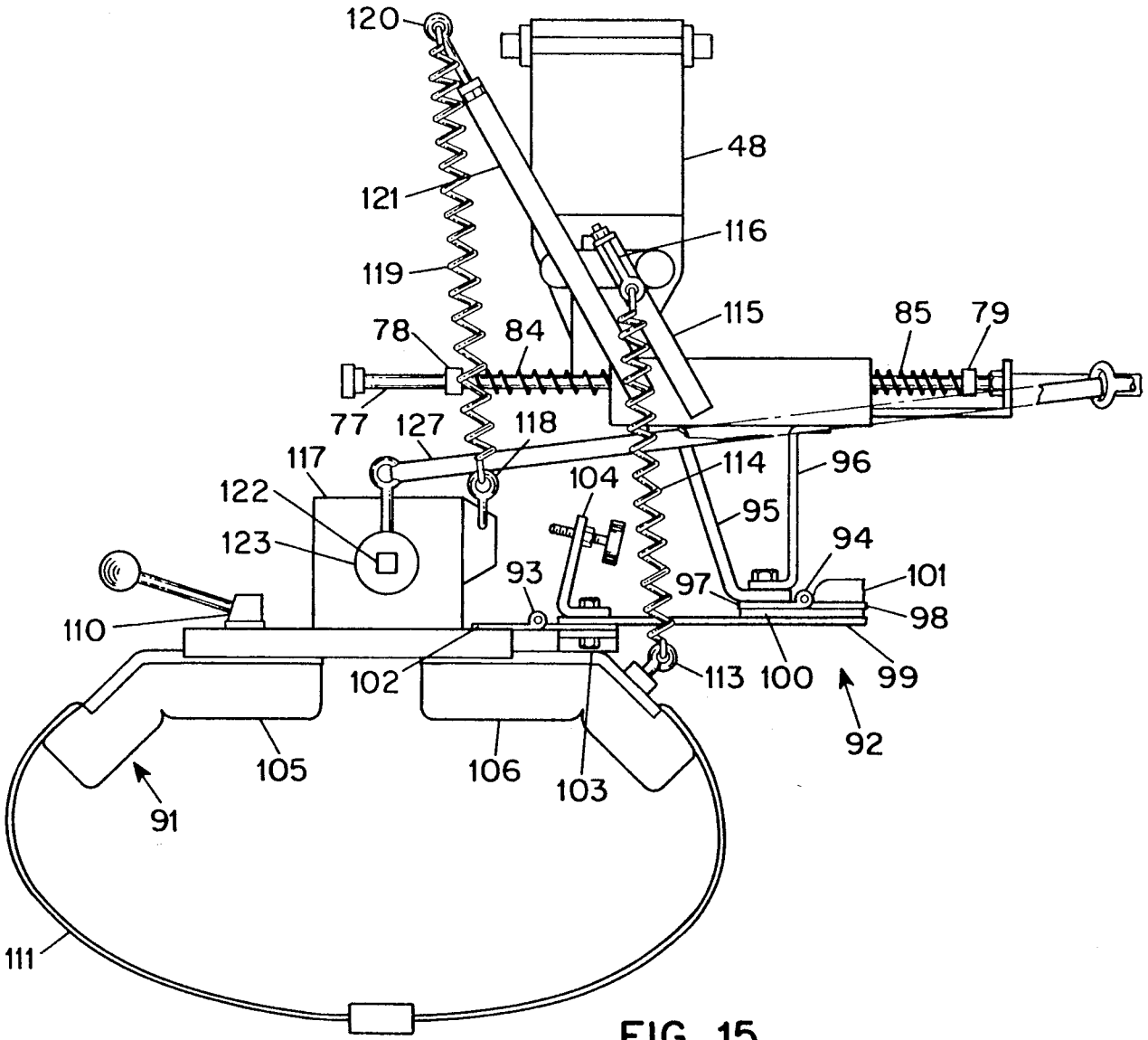
FIGS. 15, 16 and 17 are pictorial representations of the various positions through which the saddle assembly moves during a golf swing in accordance with the present invention.
Figure 19:
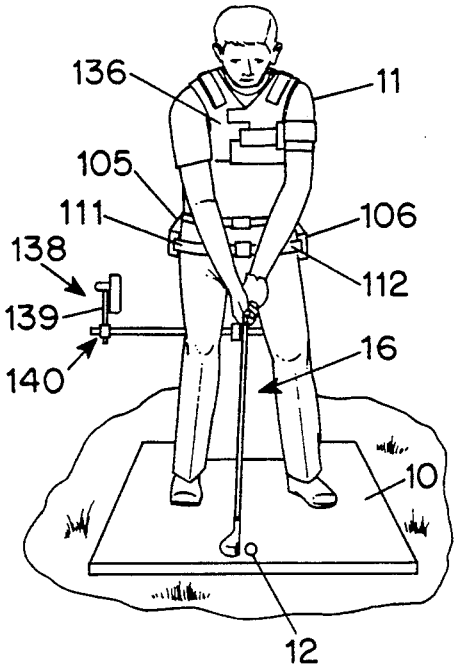
FIGS. 19-26 are pictorial representations of the golf training apparatus of the present invention in use in training a golfer.
Figure 20:
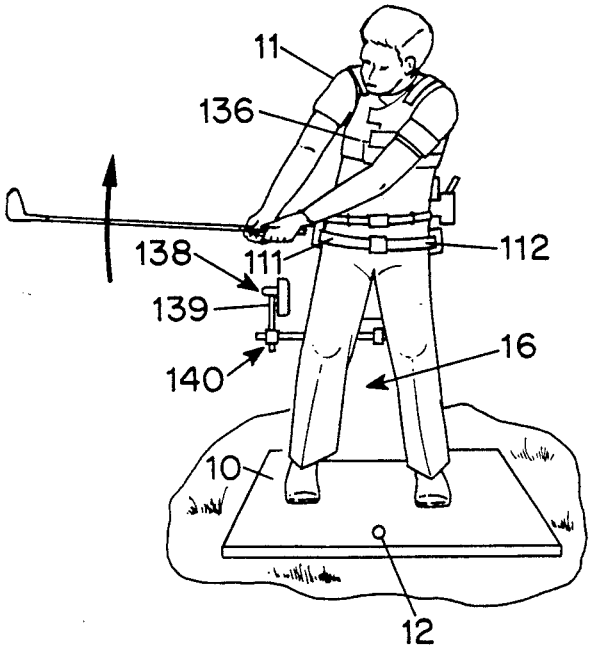

FIG. 19 shows a golfer in a golf training machine in accordance with the present invention at the address position and FIG. 15 shows the position of the hip saddle 91 and traveler assembly 83 at that point. The hip saddle 91 is strapped at the golfer's hips and is essentially horizontal. As can be seen in FIG. 15, the traveler assembly 83 is positioned midway along the traveler bar 61 with springs 84 and 85 under equal compression. The springs 84 and 85 act to center the traveler assembly 83. Thus the back support assembly 122 and the shoulder bar 135 form a "T" holding the golfer's body 11 in the proper position. Elastomeric strap 127 is under no or slight tension and adds essentially no torque to the back support assembly 122. Spring 114 acts to hold the hip saddle 91 from movement around pivot 93. Spring 119 is only under light tension and essentially has neutral action. The action of base plate 47, traveler support plate 48 hinge mechanism 49 and springs 50 and 51 in combination with base saddle 17 and springs 34 and 35 leaves the golfer free to move his upper body forward to correctly position his club without the weight of the apparatus interfering with his natural movement. Initiating the Ballard swing, the shoulders, arms, hands and center (i.e. the spine) all begin to rotate to the right together. The hips move laterally to the right while they begin the rotation. The golfer's weight begins to shift to the right foot, coiling into the set of the right leg. In the backswing, there is continued lateral movement to the right with rotation of the left hip, corresponding to the coiling of the weight into the set of the right foot, and leg, with the head and upper torso moving slightly to the right. This corresponds to FIGS. 20 and 21.

As the golfer 11 starts the backswing, he moves to the right, the traveler assembly 83 moves from two to six inches to the right, depending on the geometry of the golfer. Because of this lateral movement of the traveler assembly 83, elastomeric strap 127 is placed under tension, i.e., with a movement to the right of the traveler assembly 83, eyelet 126 is moved farther from fixed eyelet 129. This places rotational torque on the back support assembly 122 which urges the golfer's shoulders to turn in the desired direction. As the golfer's hips move to the right, saddle 91 starts to rotate clockwise around hinge 93. Spring 114 acts to prevent premature rotation and then acts to absorb the force arising from the movement in the backswing. By reason of the action of shaft 57, hip saddle 91 can adjust its angle to compensate for differences in the relative heights of the hips during the backswing. As can clearly be seen from FIG. 16, the traveler assembly 83 must move laterally to the right for clockwise rotation of the hip saddle 91. Excess rotation is prevented by limit stop 104.

Figure 21:
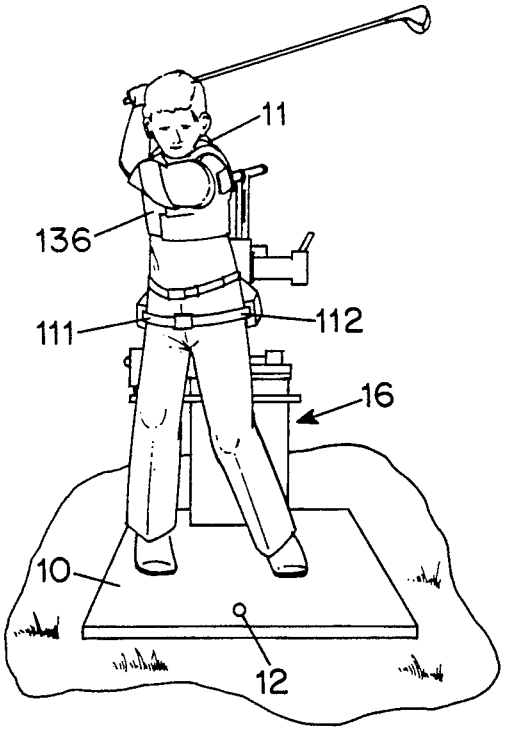
Figure 22:
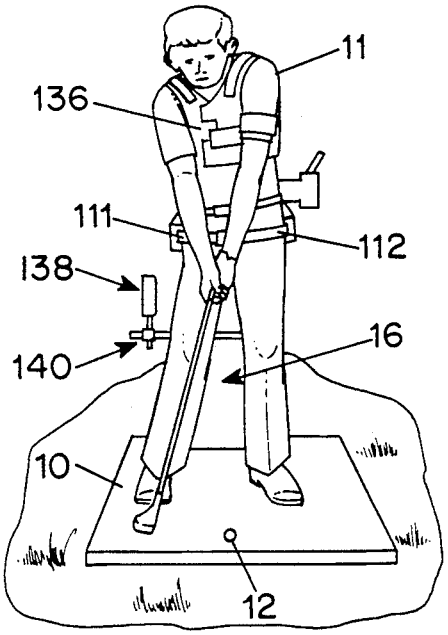
Figure 23:
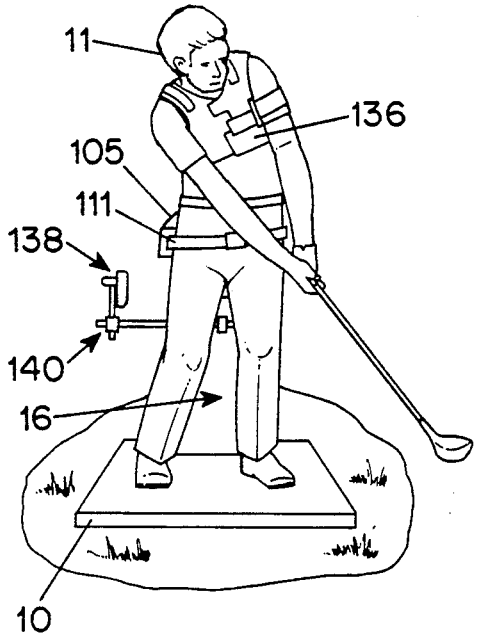
Figure 24:
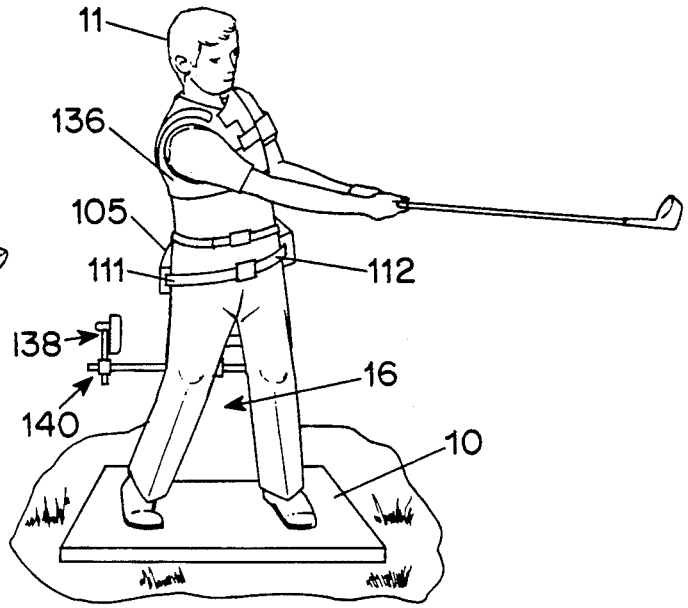
Figure 25:
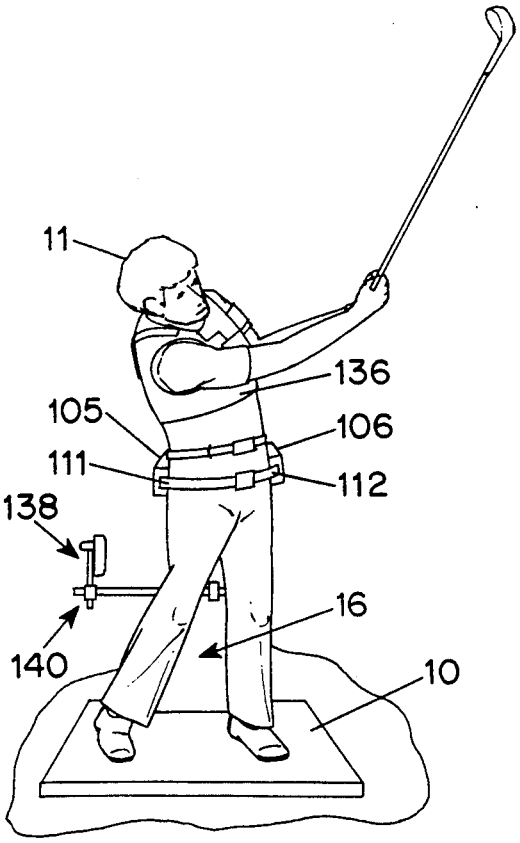
Figure 26:
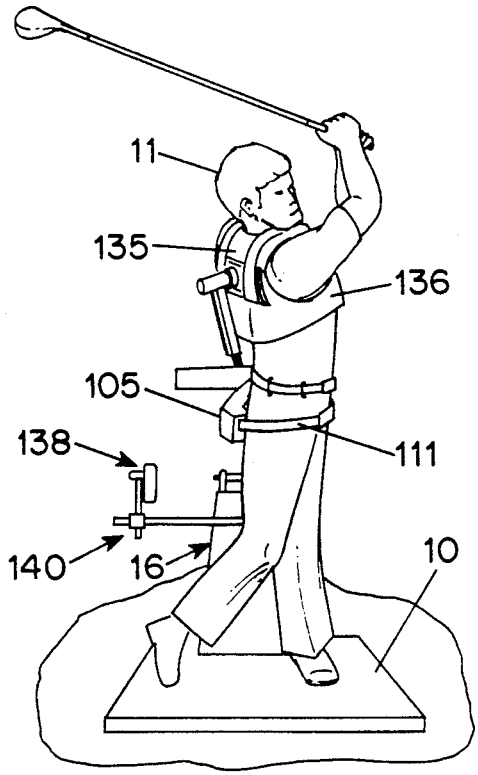

As the golfer's weight shifts to his right leg (i.e. coils into the set of the right leg), leg movement limiting device 138 acts as a target towards which the golfer can move his right leg (for a right handed golfer) and at the completion of the backswing acts to prevent excessive shift of weight or movement of the right leg, as seen in FIG. 21.

Figure 16:
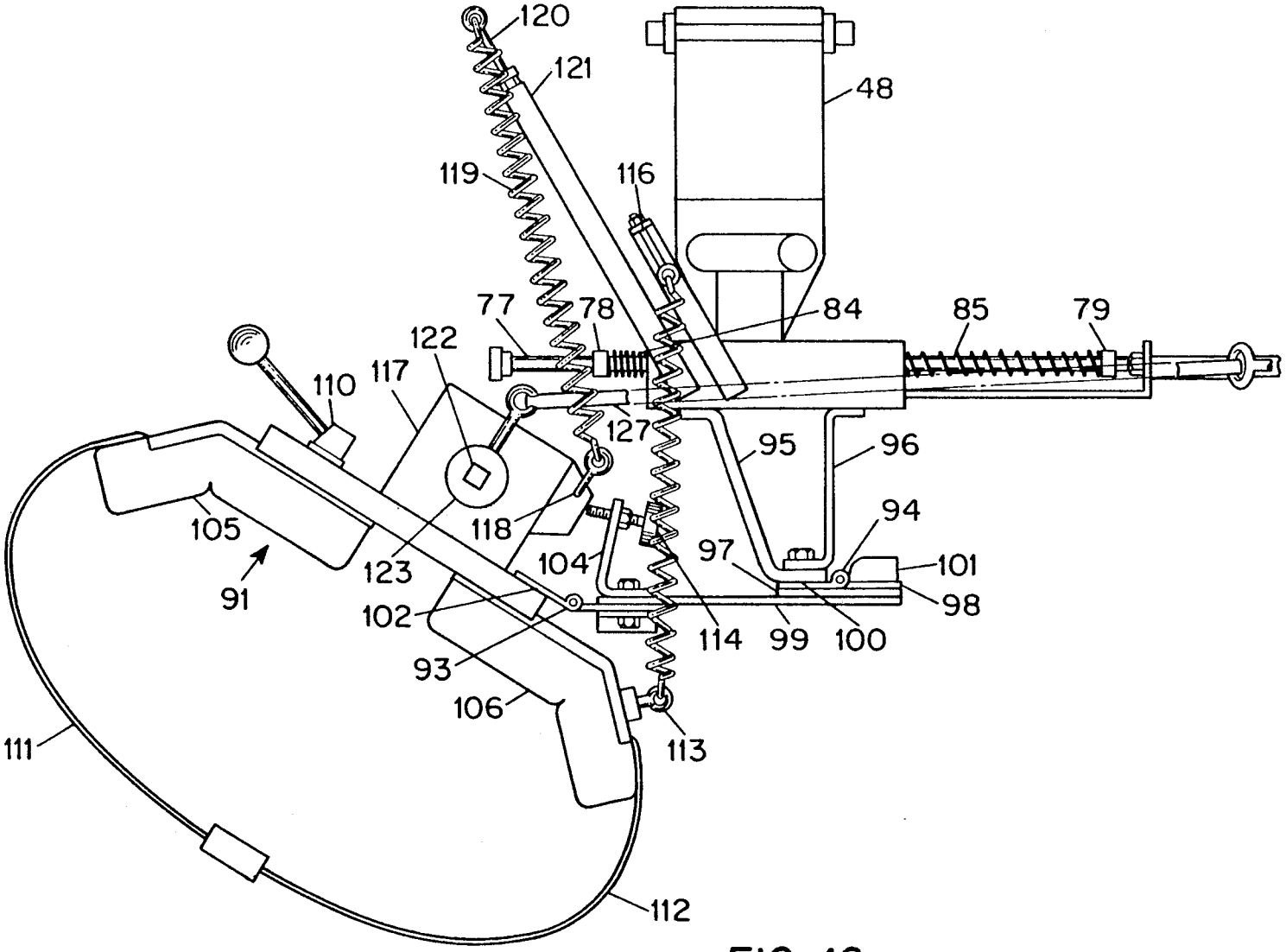
Figure 17:
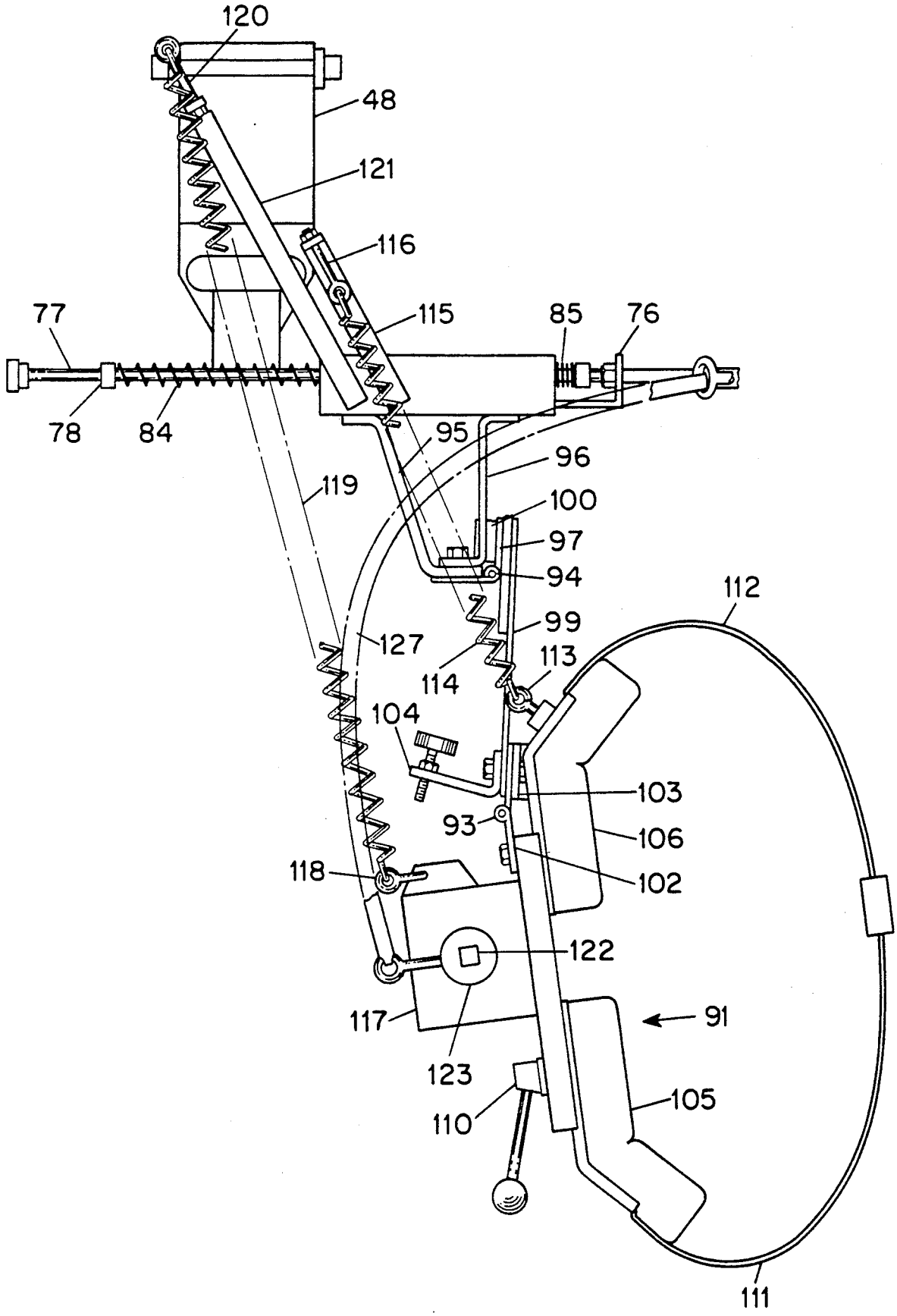

In the Ballard swing, the transition from the completion of the backswing (i.e., the reversal point) to the start of the downswing is created by the kick of the right foot, right knee and right hip toward the ball. It is this move that sets the club on the proper downswing plane. The downswing should start from the feet, legs and hips rather than the shoulders. As can be seen in FIGS. 16 and 21, at the reversal point, elastomeric strap 127 is in tension, restraining movement of the shoulders at the start of the downswing, spring 85 is compressed and spring 84 is relaxed. This acts to urge the required hip action in starting the downswing. Thus through the restraining action on the shoulders by strap 127 and the positive action of spring 84, the device urges the feet, legs and hips to start the downswing.

As the downswing progresses the hip saddle 91 (and thus the golfer's hips) rotate around hinge 93 and move laterally as the traveler assembly 83 moves along traveler bar 61, producing a combined rotational and lateral movement as required in the Ballard swing. The golfer strikes the ball at approximately the time the golfer returns to the initial address position. That is, the traveler assembly 83 has moved back into the center of the traveler bar as seen in FIG. 15. Springs 114 and 119 prevent rotational movement of the hip saddle 91 around hinge 94. Tension is relaxed on elastomeric strap 127 and thus there is no torsion on the back support assembly 122.

As the golfer continues his follow-through as seen in FIGS. 23 through 26, his hips continue to rotate until they face the target or to the left of the target. During this follow-through, the golfer must complete the swing with the knees, hips and shoulders level and the weight entirely on the left side. At the completion of the follow-through, the hip saddle 91 is in the position shown in FIG. 17. During the follow-through, the traveler assembly 83 continues movement to the left as the hip saddle rotates counter clockwise around hinge 94. This completely relaxes the tension on elastomeric strap 127 allowing free movement of the shoulders in the follow-through. Springs 114 and 119 act to prevent premature rotation of hip saddle 91 around hinge 94. Spring 114 also acts to prevent any clockwise rotation around hinge 93. Spring 114 does cause a slight counter clockwise rotation of the hip saddle 91 around hinge 93 assuring that the golfer's hips are either aligned with the target or slightly to the left of the target as required in the Ballard swing. Springs 114 and 119 also act to absorb the energy generated by this motion.

As can be seen from the above, the present apparatus urges the golfer to move in the desired Ballard swing and acts to prevent swings contrary to this desired pattern. It is impossible to successfully complete a golf swing other than a Ballard swing in this apparatus. Performance of a number of practice swings in the apparatus trains the golfer's body to the correct feel of the Ballard swing. Since the apparatus may be used in conjunction with a golf ball, the apparatus not only urges the body into the correct swing, but gives the actual feel involved in properly striking the ball and allows observation of the result of a correct swing.

The above description and drawings have been set forth in connection with training a right-handed golfer. Simple corresponding changes in the apparatus and directions of movement would adapt the present invention for use of a left-handed golfer.

Equally it would be appreciated that various specific details of the present invention disclosed in conjunction with the description of the present invention have been given by way of illustration only and are not to be taken as or construed in a limiting sense.

We claim:

1. A golf swing training apparatus comprising:

a saddle for attachment to the hips of a golfer;

a first assembly which guides the saddle in lateral movements during a golf swing; and a second assembly which operatively connects the saddle to the first assembly and which promotes (a) a rotational movement of the saddle around a first axis during a golfer's backswing and (b) a rotational movement of the saddle around a second axis during a golfer's follow-through.

2. An apparatus according to claim 1 wherein the second assembly is a hinge and spring assembly.

3. An apparatus according to claim 2 wherein the second assembly includes a first hinge around which the saddle moves during the backswing and a second hinge around which the saddle moves during the follow-through.

4. An apparatus according to claim 1 wherein the first assembly includes a traveler assembly movably mounted on a straight track to move laterally along the track during the golf swing.

5. An apparatus according to claim 4 wherein the saddle swings away from the track during the follow-through.

6. An apparatus according to claim 4 further comprising a base which supports pivotable connecting means on which the straight track is rotatably mounted.

7. An apparatus according to claim 6 wherein the pivotable connecting means promotes vertical movement of the track during the golf swing.

8. An apparatus according to claim 6 wherein the pivotable connecting means is a pin and spring assembly.

9. An apparatus according to claim 6 wherein the rotatably mounted track adjusts the angle of the saddle relative to the height of the golfer during the golf swing.

10. An apparatus according to claim 6 further comprising a leg movement limiting device which is attached to the base and positioned to limit the golfer's leg movement during the golf swing.

11. An apparatus according to claim 10 wherein the leg movement limiting device is attached to the surface on which the golfer stands.

12. An apparatus according to claim 1 further comprising a third assembly which positions the golfer's shoulders throughout the swing and which is, at one end, attached to the shoulders of the golfer and, at the other end, rotatably mounted on the saddle.

13. An apparatus according to claim 12 wherein the third assembly restrains movement of the shoulders at the start of a golfer's downswing.

14. An apparatus according to claim 12 wherein the second assembly promotes rotation of the saddle around the first axis at the start of the downswing.

15. An apparatus according to claim 12 wherein the third assembly includes:

a vest having a front and back to be worn by the golfer, a rigid plate attached to the back of the vest, a support assembly which is attached at its upper end to the plate and which is rotatably mounted at its lower end on the saddle, and tension means which apply rotational force to the support assembly during the golfer's backswing.

16. An apparatus according to claim 15 wherein the support assembly is vertically extensible.

* * * * *